United States Patent [19]

Gelinas et al.

[11] Patent Number: 4,759,477

[45] Date of Patent: Jul. 26, 1988

[54] VARIABLE FLOW RATE DISPENSING VALVE ASSEMBLY

[75] Inventors: William A. Gelinas, Hadley, Mass.; Robert N. McDermott, Wethersfield, Conn.

[73] Assignee: Corporation Loctite, Newington, Conn.

[21] Appl. No.: 37,237

[22] Filed: Apr. 10, 1987

Related U.S. Application Data

[62] Division of Ser. No. 745,655, Jun. 17, 1985, Pat. No. 4,678,100.

[51] Int. Cl.[4] ..... B05C 11/00

[52] U.S. Cl. ..... 222/504; 222/52; 91/189 R; 92/68; 251/62

[58] Field of Search ..... 222/504, 52; 92/68; 91/189; 118/685; 251/62, 63.4, 279

[56] References Cited

U.S. PATENT DOCUMENTS 616,886 1/1899 Brinkmann ..... 92/68
2,386,589 10/1945 Caldwell ..... 251/62 X
3,533,596 10/1970 Daume ..... 92/107 X
4,013,037 3/1977 Warning, Sr. et al. ..... 118/685
4,584,964 4/1986 Engel ..... 901/43 X

FOREIGN PATENT DOCUMENTS 56-80513 7/1981 Japan ..... 92/117 A

*Primary Examiner*—Charles A. Marmor
*Attorney, Agent, or Firm*—Perman & Green

[57] ABSTRACT

A material dispensing valve finding particular application in the robotic dispensing of sealants, adhesives, etc. in a desired pattern on a workpiece. The dispensing valve comprises a unique actuating arrangement wherein back to back pancake cylinders are moveably arranged within a housing and, depending upon how the cylinders are actuated, three or four dispense rate positions can be provided. The dispense rate positions of the valve are preferably coordinated with the rate of movement of the robotic system so that the dispense rate is appropriate for the rate of movement.

3 Claims, 9 Drawing Sheets

VARIABLE FLOW RATE DISPENSING VALVE ASSEMBLY

This is a division of co-pending application Ser. No. 745,655, filed on June 17, 1985, now U.S. Pat. No. 4,678,100, issued July 7, 1987.

BACKGROUND OF THE INVENTION

This invention relates to poppet-type valves which are used in dispensing material such as sealant, adhesives, etc.

There is a growing need for valve assemblies usable in the fields of robotic and automatic application of materials such as sealants or adhesives. Prior art poppet-type valves, such as those sold by Loctite Corporation, Newington, Connecticut and disclosed in Loctite's equipment catalog LT-859 8/84 entitled "Loctite/New Dimensions In Dispensing Systems Especially Designed For Loctite Adhesives and Sealants", having two positions, on and off, are known in the art. Such valves are generally motor driven to reach their two positions wherein they are either opened or closed. Prior art poppet-type valves are not known which are capable of movement between three of four positions. Furthermore, popper-type valves of the prior art are not easily adjusted and readjusted with respect to the stroke of the piston acting on the valve stem.

When conventional poppet-type valves are utilized in robotic and automatic applications wherein the valve is attached to a robot arm and is moved by the robot in a predetermined pattern, problems arise due to the fact that the dispensing head velocity must change depending on the pattern being laid down. For example, if it is desired to lay a pattern of adhesive sealant, locking compound or other dispensed material in a desired pattern on a plate, the valve mounted on the arm of the robot would move along the desired dispensing path. It would normally move with its highest velocity along the straight line portion of said path. However, when the arm encounters a curved path, and particularly one of a small radius, the arm has to slow down to accumulate the necessary control information and make the mechanical movement because of the way the robots are controlled. At this point, a conventional two way valve which is in the opened positioned is unable to shut down to a slower dispense rate to account for the slower arm speed. Consequently, excess material is deposited at such locations which is undesirable.

It is a basic problem with respect to the control of such robots that they cannot move through an intrically shaped geometric pattern with curved and straight paths intermixed without changing speed. If the robot could move through such shapes without changing speed, the conventionally available poppet-type valve might be acceptable. However, since this is not the case, a valve assembly has been developed in accordance with this invention that will allow selectively different flow-rates which can be tied to the velocity of the robot.

The prior art poppet-type valve structures generally comprise a valve stem connected to a single cylinder piston rod. Since these valves have only two positions, open and closed, there is no easy way to adjust the stroke of such poppet-type valves to control precisely the dispensing rate. The way that this has been done in the past is to shave the material between the housing and the body of the valve and shorten the valve stem such as by cutting off a section of the stem and using a coupling to rejoin the stem sections for an overall shorter stem. In addition, the prior art valves can be motor driven or solonoid-activated to accomplish rapid opening and closing.

It is the purpose of this invention to provide an improved variable flow-rate dispensing valve assembly. The valve assembly is adapted for three or four position operation, and is particularly useful in conjunction with a robotic material application system.

The improved dispensing valve assembly of this invention is capable of providing a plurality of preselected material flow-rates. In accordance with one embodiment a three-way valve assembly is provided in including two preselected flow-rates of material and a shut-off position. In accordance with a more preferred embodiment of the present invention, a four-way valve assembly is provided including three preselectable material flow-rates of material and a shut-off position. The preselectable flow-rates may be easily obtained by an improved system for adjusting the stroke of the valve stem. The valve assembly of this invention finds particular application in a robotic system for applying the desired material to a workpiece.

SUMMARY OF THE INVENTION

In accordance with this invention, a variable flow-rate dispensing valve assembly is provided having particular application for use in the robotic and automatic application of materials such as sealants, adhesives, etc. In contrast with prior art two position valves, the valve assembly of this invention can be a three position or even a four position valve. This allows the valve to be controlled in a manner to coordinate the dispense rate of the material even for intricate patterns where the velocity of the robotically supported dispense head must change.

The material dispensing valve assembly of this invention comprises back to back, first and second pancake cylinders which comprise closed bodies defining respective internal chambers. First and second pistons are slidingly arranged within the respective first and second cylinder chambers. The pistons divide each such chamber into a first section adjacent one side of each respective piston and a second section adjacent the other side of each respective piston. First and second piston rods connected to the respective first and second pistons extend in a opposing directions and outwardly of the cylinder bodies. The cylinders are arranged back to back such that the second section of each cylinder chamber are arranged adjacent one another.

A first port is provided in said first cylinder body communicating with said first section of said chamber therein. A second port is provided in the first cylinder body which communicates with the second section of the chamber therein. A third port is provided in the second cylinder body communicating with the second section of the chamber therein, and a fourth port is provided in the second cylinder body communicating with the first section of the chamber therein. Each of said ports are adapted for alternately pressurizing or exhausting said respective sections of said chambers.

A housing is provided for supporting the back to back cylinder bodies for movement relative thereto and the first piston rod is secured to the housing.

Means are provided, supported by the housing, for dispensing the desired material. The dispensing means includes a valve for controlling the dispense rate of the material and actuating means for controlling the dispense rate of the valve. The actuating means is connected to and is operationally responsive to the movement of the second piston rod.

By selectively pressurizing and exhausting the respective sections of the cylinder body chambers in operation of the improved valve assembly, it is possible to actuate the valve assembly to provide three or four position operation. In the three position operation high and low dispense rates are provided as well as a closed position. In the four position operation, high, medium, and low dispense rates are provided as well as a closed position.

It is also possible in accordance with this invention to readily adjust the stroke of the dispensing valve stem to control the dispense rate for any given valve position.

It is preferred, in accordance with this invention, that the aforenoted valve assembly be utilized in conjunction with a robotic material application system. It is further preferred that the control of the valve assembly in accordance with this invention, be tied to the control of the robotic mechanism.

DETAILED DESCRIPTION OF THE PREFERRED EMBODIMENT

Figure 1:
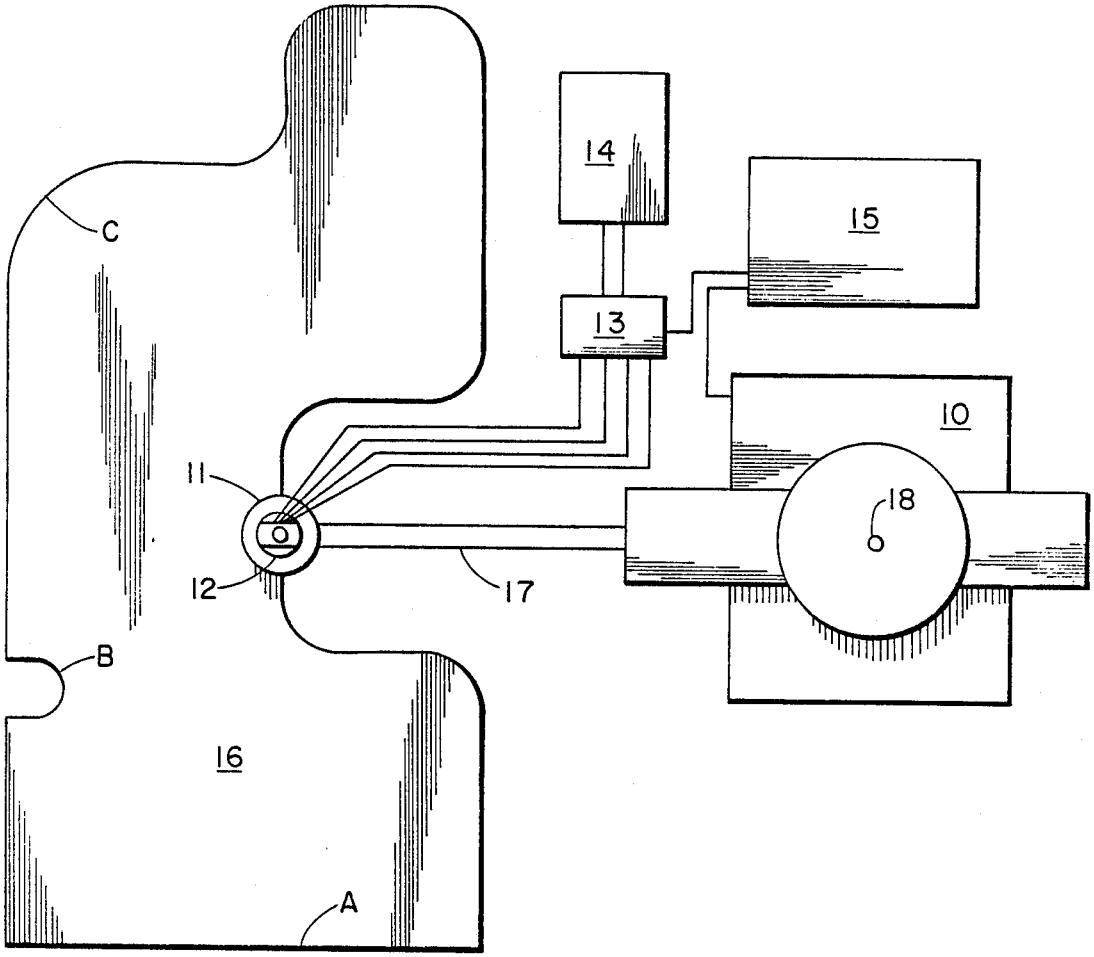
FIG. 1 is a schematic representation of a robotic sealant or adhesive application system utilizing a variable flow rate dispensing valve assembly of this invention.

Referring now to FIG. 1, there is shown a robot system 10 having a dispensing head 11 utilizing the variable flow-rate dispensing valve assembly 12 of this invention. The valve assembly 12 of this invention is pneumatically actuated via pneumatic control system 13 which controls the selective application of the pneumatic pressure from the source 14 of pneumatic pressure which can comprise compressed air. The pneumatic control system 13 is preferably actuated by the programmable controller 15 which preferably also controls the robot system 10.

The variable flow-rate dispensing valve assembly of this invention can be employed in an automatic dispensing system 10 as depicted in FIG. 1 for applying material such as sealants, adhesives, locking compounds, etc. in a desired pattern 16 an example of which is exemplified in FIG. 1. This pattern would be laid down upon a sheet or some other suitable surface, edge or opening having a similar configuration. Such an automatic system is disclosed in commonly assigned U.S. application of W. Gelinas, E. Holtz, D. Argazzi, R. Smigel and D. Wiley, Ser. No. 06/745,656, filed 6/17/85 entitled "Bonding Apparatus and Process" now U.S. Pat. No. 4,661,190 issued 4/28/87, which is incorporated by reference herein.

A problem exists with respect to prior art approaches for dispensing such a pattern. When the robot 10 telescoping arm 17 moves the dispensing head 11 along the pattern 16, it is subject to velocity variation depending on whether an intricate curve or a straight line portion is being dispensed.

For example, a straight line portion of the pattern A would normally have the dispense head 11 moving at its maximum velocity so that the valve 12 could be fully open and provide the maximum dispense rate. Then when the head 11 reaches the small diameter curve B, it would have to slow down because of the way robots are controlled. If the robot arm 17 slows down in a curve B, then the fully open dispense rate, if continued, would put down excess material. In accordance with this invention, the valve assembly 12 is adapted to provide a variable flow-rate so that a low flow-rate could be used to form the pattern B. In a most preferred embodiment, an intermediate flow-rate is provided by the valve 12 for other portions of the pattern such as C where the dispense head 11 slows down but not as much as for the small diameter curve B.

The basic problem which has been illustrated is that the controls for the robot 10 are such that they really can't move the dispense head 11 through an intrically shaped geometry or pattern without changing speeds. Because of these limitations, in accordance with this invention, a variable flow-rate dispensing valve 12 is provided which will allow at least two different flow-rates to issue from the dispense head 11, and preferably at least three different flow-rates.

The robot system 10 is able to move the dispense head 11 about the pattern 16 by the use of the telescoping arm 17 and by pivoting the arm 17 about axis 18. The robot system 10 may be of any conventional design. The present invention is principally concerned with the dispensing head 11 which is carried by the robot system 10.

Figure 3:
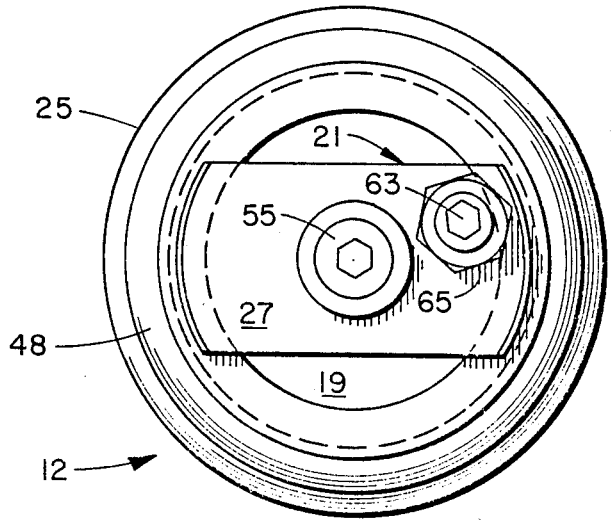
FIG. 3 is a top view of the valve assembly of FIG. 2 with the pneumatic actuating and control system deleted.
Figure 2:
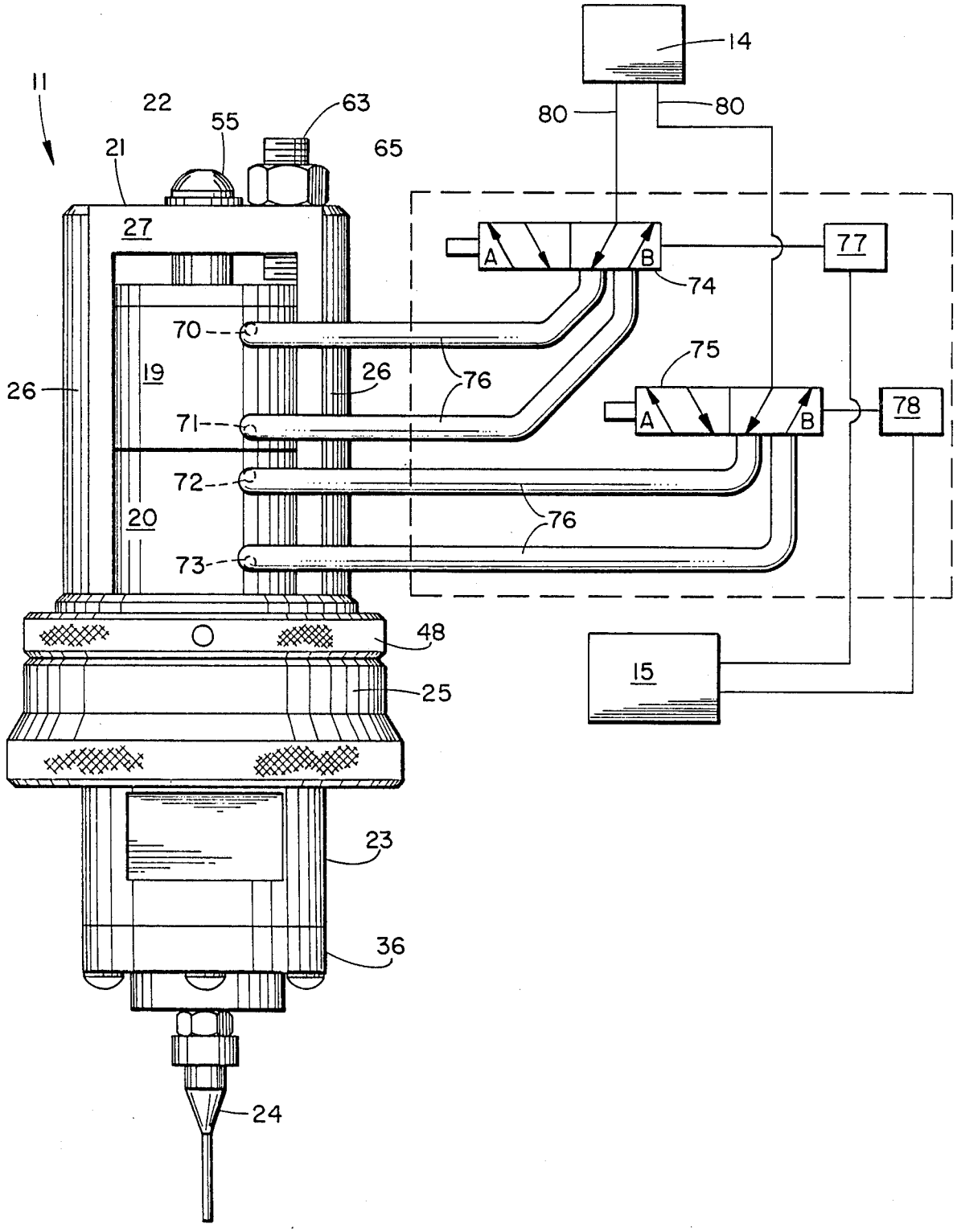
FIG. 2 is a side view of the valve assembly of this invention showing schematically the pneumatic actuation control system.

Referring now to FIGS. 2 and 3, the dispensing head will be discussed in greater detail. It is noted that FIGS. 5–12 are not truly to scale, particularly with regard to the depth of the end cap 36. The cavity within end cap 36 has been exaggerated somewhat in the vertical plane of the figures to clearly show the various positions of bulbous portion 40 of valve piston rod 54 for each of its open positions. Back to back pancake cylinders 19 and 20 are supported for a movement within a U-shaped housing 21 along axis 22. A valve body 23 for controlling flow-rate of the material being dispensed from the dispensing orifice or needle 24 is connected to the housing 21 by means of a collar 25. The housing 21 includes opposing vertical walls 26 having a cross section corresponding to a segment of a cylinder. The sidewalls 26 are connected by a top portion 27. In practice, preferably, the U-shaped housing 21 comprises a unitary member and the free end of the sidewalls 26 preferably include a outside thread 28 adjacent the free ends. The collar 25 is internally threaded at 29 so that it can mate with the external thread 28 of the housing 21.

Figure 4:
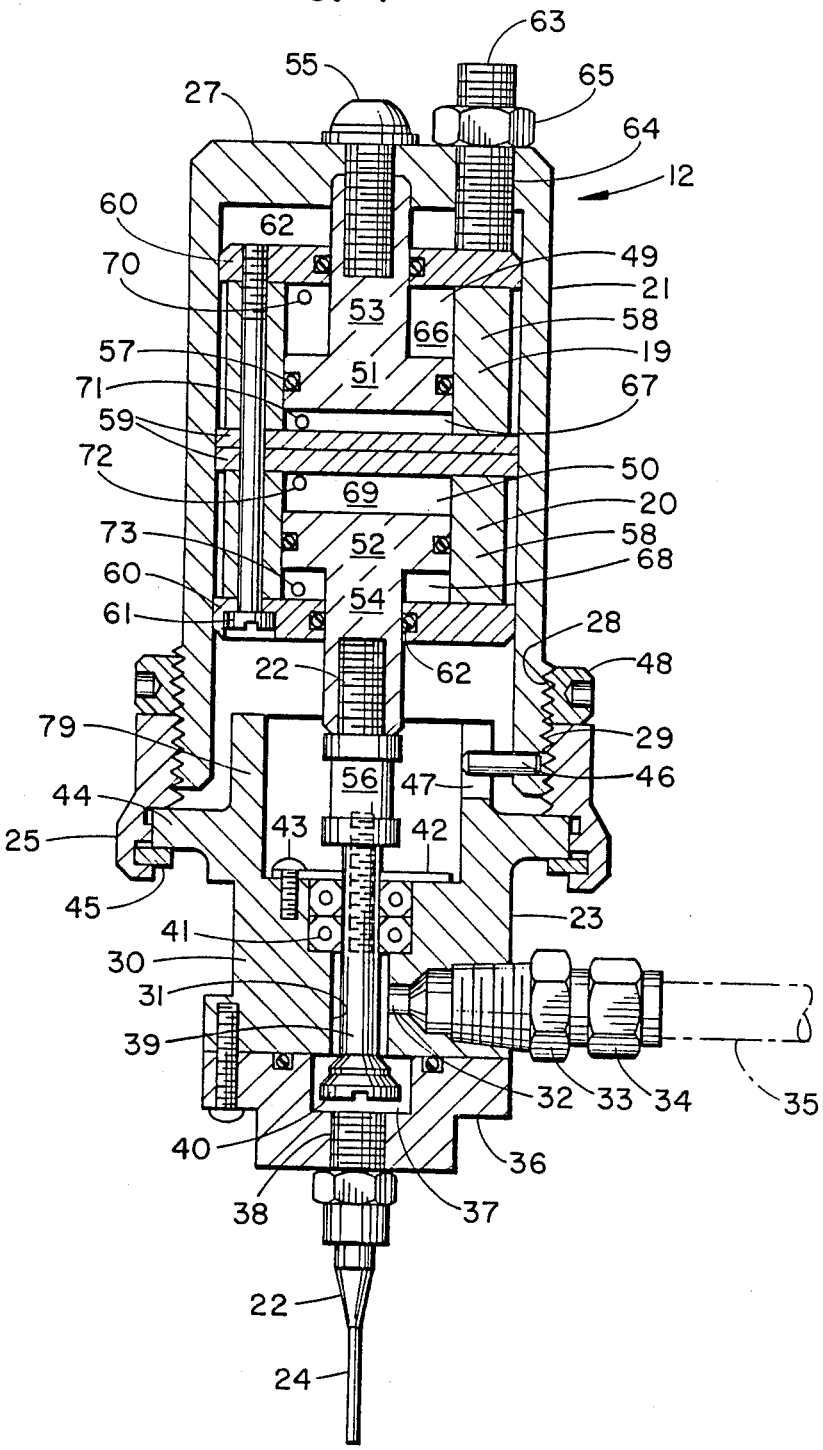
FIG. 4 is a view of the valve assembly of this invention in partial cross-section.

Referring now to FIGS. 2, 3 and 4, with particular emphasis on FIG. 4, the internal details of the valve assembly 12 of this invention will be described. The valve body 23 is comprised of the main body member 30 having a material dispensing passageway 31 centrally thereof. A material supply passageway 32 is arranged in the side of the passageway 31 at one end while its other end is arranged to receive a conventional plumbing fitting 33. The plumbing fitting 33 is connected via fitting 34 to a supply hose 35 which in turn is connected to a source of the material to be dispensed under pressure (not shown).

An end cap 36 is sealingly secured to the main body 30. The end cap 36 has a chamber 37 with a larger diameter than the passageway 31 in the main body 30. Chamber 37 has a threaded orifice 38 into which is screw the dispensing needle 24. A valve stem 39 is arranged for movement within the passageway 31 along the axis 22. The lower end of the valve stem 39 includes a bulbous portion 40 which is wider than the passageway 31 and serves to stop flow of material from the passageway 31 into the chamber 37, when the bulbous portion 40 is pressed against the end of the passageway 31 by movement of the valve stem upwardly. Similarly, when the valve stem 39 moves downwardly, material entering the passageway 31 from the supply passageway 32 is adapted to pass over the bulbous portion 40 and into the dispensing chamber 37 of the end cap 36. The further the movement of the bulbous portion 40 away from the end of the passageway 31, the higher the flow rate of material issuing from the needle 24 and vice versa. The opposing end of the passageway 31 is sealed by means of double O-ring seals 41. Seals 41 are held in place by cover plate 42 which is secured by screws to the main body 30. The valve stem 39 extends axially outwardly past the cover plate 42.

The main body 30 includes a circumferential flange 44 for supporting the collar 25. A retaining ring 45 locks the collar 25 onto the main body 30 while allowing the collar to rotate freely about the axis 22. The housing 21 is connected to the main housing 30 by threaded engagement with the collar 25. Accordingly, when the collar 25 is rotated in one direction, the housing 21 moves away from the main body 30. Correspondingly, when the collar 25 is moved in the opposing direction, the housing 21 moves toward the main body 30.

In order to prevent the housing 21 from rotating during movement, pin means 46 is supported within a threaded hole in the housing 21. The set screw 46 extends into a slot 47 in the main body 30 and thereby serves to prevent the housing 21 from rotating when the collar 25 is rotated to move the housing toward or away from the body 30. When the housing 21 is positioned as desired, its position is locked in place by means of a lock nut collar 48. This is done by screwing the lock nut collar 48 into engagement with the collar 2 whereat the collar 25 is locked in place. Similarly, if it is desired to move the collar 25, the lock nut collar 48 is first unscrewed from engagement.

Having just described the dispensing valve portion of the variable flow-rate dispensing valve of this invention, attention will now be drawn to the system for actuating the dispensing valve to control the respective flow rates selectively. The actuating system is comprised of the aforenoted back to back pancake type pneumatic cylinders 19 and 20. The first or upper pneumatic cylinder 19 comprises a closed body defining a respective internal chamber 49. The second pneumatic cylinder 20 also comprises a closed body defining a respective second internal chamber 50. A first piston 51 is arranged to slide within the first chamber 49. A second piston 52 is arranged to slide within the second chamber 50. A piston rod 53 connected to piston 51 extends upwardly about axis 22. A piston rod 54 connected to the piston 52 extends downwardly about the axis 22. The piston rod 53 extends outwardly from the cylinder 19 and is secured to the top portion 27 of the housing 21 by means of screw 55. The piston rod 54 extends downwardly out of the cylinder 20 and a coupling 56 is screwed into its free end. The piston rod 54 is connected via the coupling 56 to the valve stem 39 which is screwed into a threaded hole in the coupling.

In the arrangement which has been described, the pneumatic cylinders 19 and 20 are arranged for movement along the axis 22 within the housing 21. The movement of the cylinders 19 and 20, in conjunction with the movement of piston 52, determines the degree to which the valve stem 39 is moved within the dispensing passageway 31.

The piston 51 and 52 are sealed during their movement by means of circumferential seals 57 such as O-rings which engage the internal sidewall of the respective chambers 49 and 50. The cylinders 19 and 20 are comprised of sidewalls 58, bottom plates 59 sealingly secured thereto and top plates 60 also sealingly secured to the sidewalls 58. The respective sidewalls 58, bottom plate 59, and top plate 60 are secured together by means of screws 61.

The piston rods 53 and 54 extend outwardly of the cylinders 19 and 20 through holes in the respective top plate 60 which are O-ring sealed by means of O-ring 62. A threaded screw 63 extends through a threaded hole 64 in the top portion 27 of the housng 21. The screw 63 is intended to provided a stop with respect to the vertical movement of the cylinders 19 and 20. The screw 63 is locked in place by means of a lock nut 65.

The piston 51 divides the internal chamber 49 in the first cylinder 19 into a first section 66 on one of the side of the piston 51 and a second section 67 on the opposing side of the piston 51. Similarly, the piston 52 divides the internal chamber 50 of cylinder 20 into a first section 68 on one side of the piston 52 and a second section 69 at the opposing side of the piston 52.

While the operation of the valve assembly 12 of this invention will be described in greater detail hereafter, it should be apparent that by selectively pressurizing or exhausting the respective internal chambers 66, 67, 68 and 69, it is possible to obtain movement of the cylinders 20 and 21 along the piston rod 53 and movement of the piston 52 relative to the cylinders 19 and 20.

The second sections of the respective cylinders 19 and 20 are arranged back to back adjacent one another. A first port 70 for pressurizing or exhausting the first section 66 of cylinder 19 is provided adjacent top plate 60. Similarly, a second port 71 for pressurizing or exhausting the second section of cylinder 19 is provided adjacent the bottom plate 59 of that cylinder. A third port 72 for pressurizing or exhausting the second section of cylinder 20 is provided adjacent the bottom plate 59 of that cylinder. Finally, a fourth port 73 for pressurizing or exhausting the first section of cylinder 20 is provided adjacent the top plate 60 of that cylinder.

Respectively pressurizing and exhausting the respective sections of the internal chambers of a respective cylinder causes the section being pressurized to expand and the section being exhausted to contract. For the upper cylinder 19, this results in movement of the cylinder assembly comprising cylinders 19 and 20 and for the lower cylinder 20 this results in movement of the piston 52.

Referring now more specifically to FIGS. 2 and 4, the operation of the pneumatic control system 13 will be described in greater detail. The pneumatic control system 13 is comprised of two four-way solenoid actuated valves 74 and 75. The four-way valve may be any desired conventionally used valve such as the 56 Series or 58 Series valves as supplied by Mac Valves, Inc., Wixom, Mich. Conduits 76 connect ports 70 and 71 of cylinder 19 to four-way valve 74 and connect ports 72 and 73 of cylinder 20 to four-way valve 75. The four-way valves 74 and 75 are actuated by means of solenoids 77 and 78. In the positions shown for the respective valves 74 and 75, port 70 is pressurized while port 71 is exhausted. Similarly, port 72 is pressurized while port 73 is exhausted.

If the solenoids 77 and 78 are actuated to switch from the B position of the valves 74 and 75 to the A position of the valves 74 and 75, then port 70 would be exhausted, port 71 pressurized, port 72 exhausted and port 73 pressurized. In this manner, by selectively actuating the solenoids 77 and 78, it is possible to selectively pressurize and exhaust respective sections 66 and 67 of cylinder 19 and sections 68 and 69 of cylinder 20. Control of the actuation of the solenoids 77 and 78 is preferably obtained from the programmable controller 15 of the robot system 10. Although it is desired, a separate controller could be provided for the solenoids 77 and 78.

Having thus described the valve assembly 12 of this invention and its actuating system in detail, reference will now be had to FIGS. 5–12 for the purpose of illustrating the operation and control of the valve assembly 12.

Figure 5:
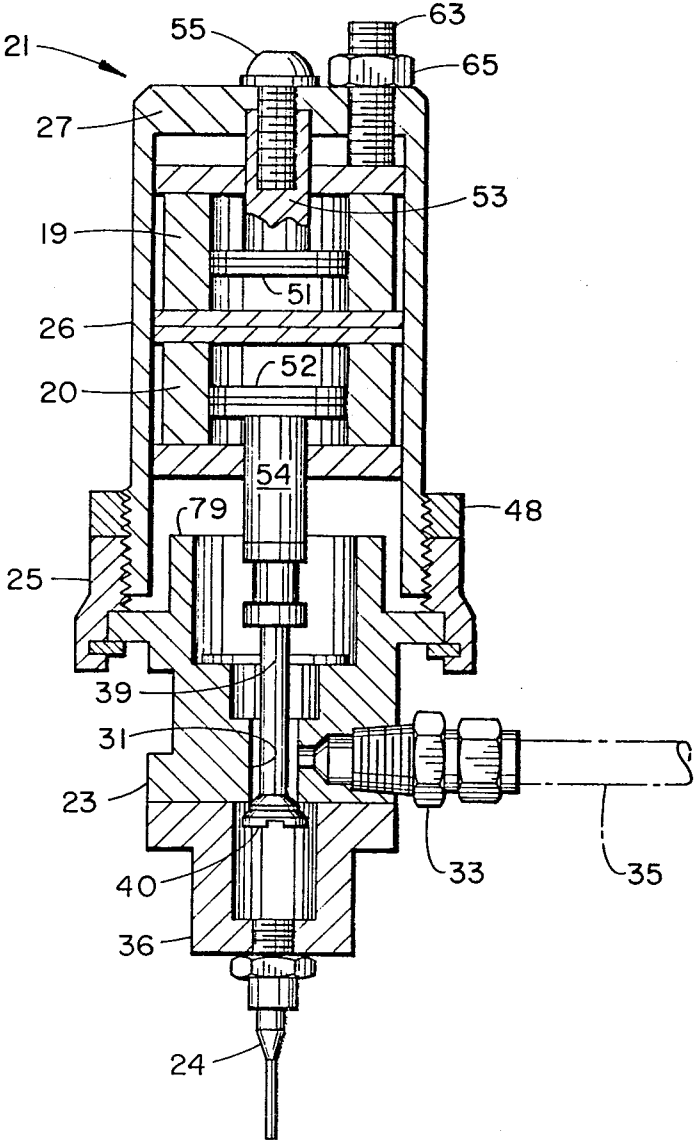
FIG. 5 is a schematic representation of a valve assembly of this invention in partial cross section in its closed position.
Figure 8:
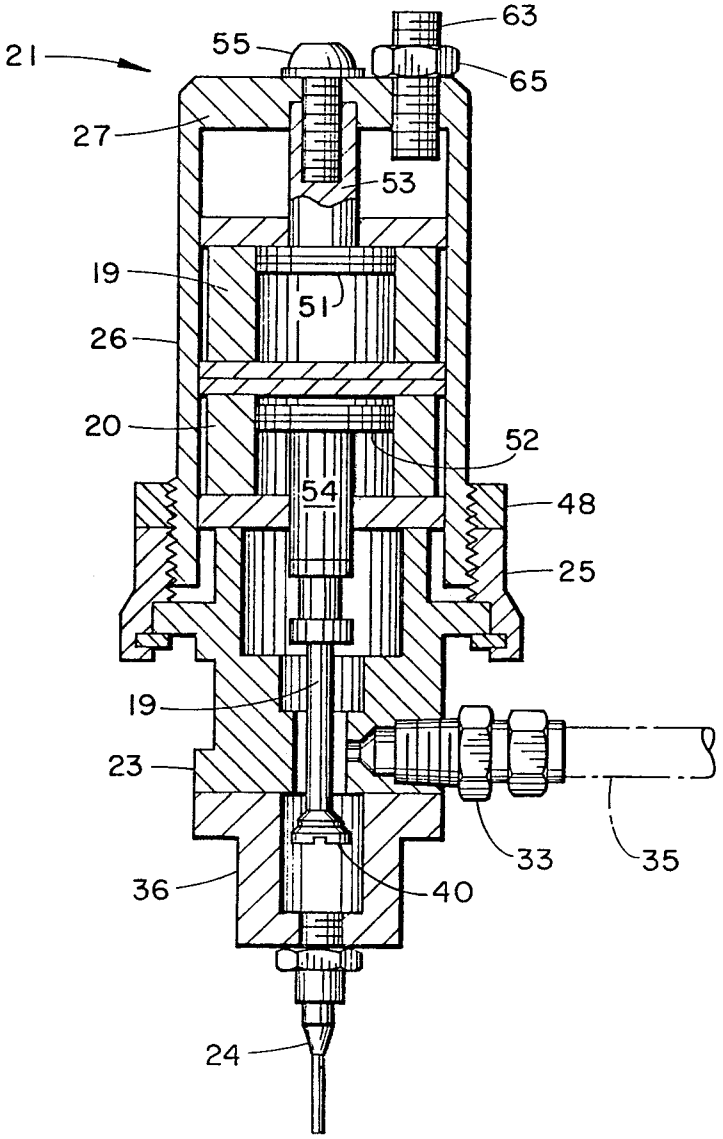
FIG. 8 is a schematic representation as in FIG. 5 with the valve in its medium dispense rate position.

In FIG. 5, the control system 13 has been actuated in a manner to close the valve 12 to stop any dispensing of material therefrom. In this embodiment, the port 70 has been pressurized, the port 71 exhausted, the port 72 exhausted and the port 73 pressurized. This would be achieved by energizing the solenoids 77 to put the four-way valve 74 in its B position and energizing the valve 78 to put the four-way valve 75 in its A position. It is apparent from FIG. 5 that the cylinder assembly comprising cylinders 19 and 20 has moved upwardly against the stop 63. Furthermore, the piston 52 and its rod 54 have moved upwardly to close off the dispense passageway 31. Namely, the bulbous portion 40 of the valve stem 39 which is secured to the piston rod 54 has moved upwardly to close off the passageway 31.

Figure 6:
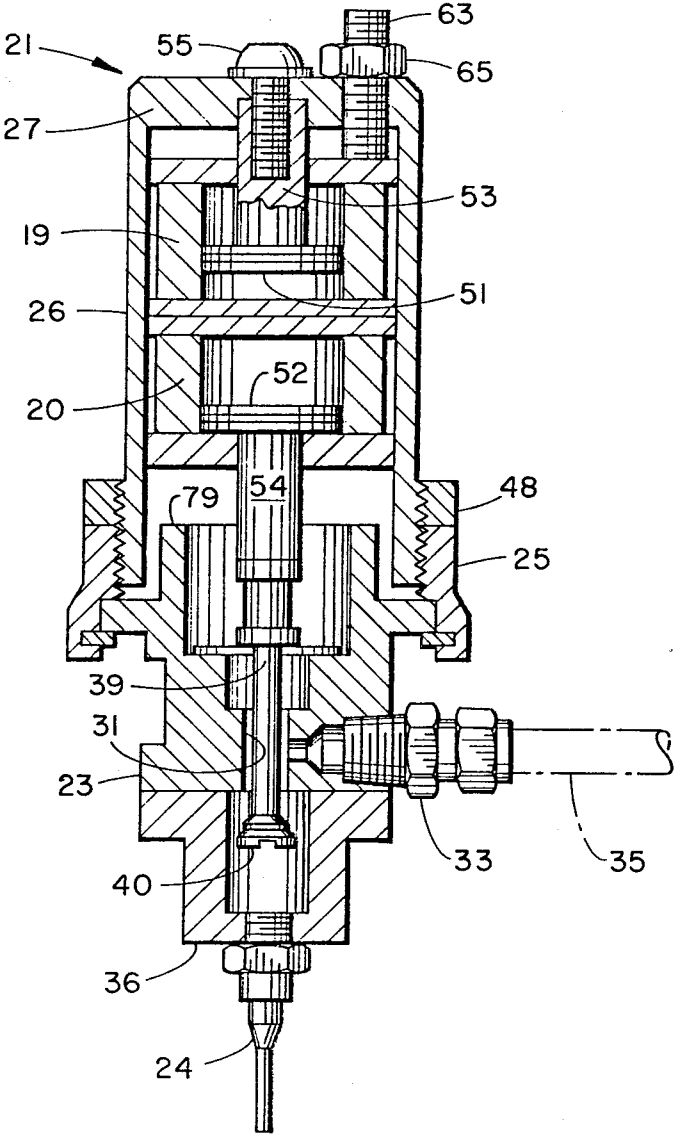
FIG. 6 is a schematic representation as in FIG. 5 with the valve in its low dispensing rate position.

Referring now to FIG. 6, the control system 13 has been actuated to provide a low dispense rate of the material from the needle 24. In this embodiment, the port 70 is pressurized, the port 71 exhausted, the port 72 is pressurized and the port 73 is exhausted. This is accomplished by actuating the solenoids 77 and 78 to provide the respective valve positions 74 and 75 as shown in FIG. 2. In this embodiment, as in FIG. 5, the cylinder assembly 19 and 20 has been moved up against the top cylinder stop 63. However, the piston 52 and its rod 54 have moved downwardly to the maximum extent thereby moving the valve stem 30 downwardly to provide clearance between the bulbous portion 40 and the dispensing passageway 31. The spacing between the bulbous portion and the bottom of the passageway 31 is relatively small therefore accounting for the low dispense rate.

Figure 7:
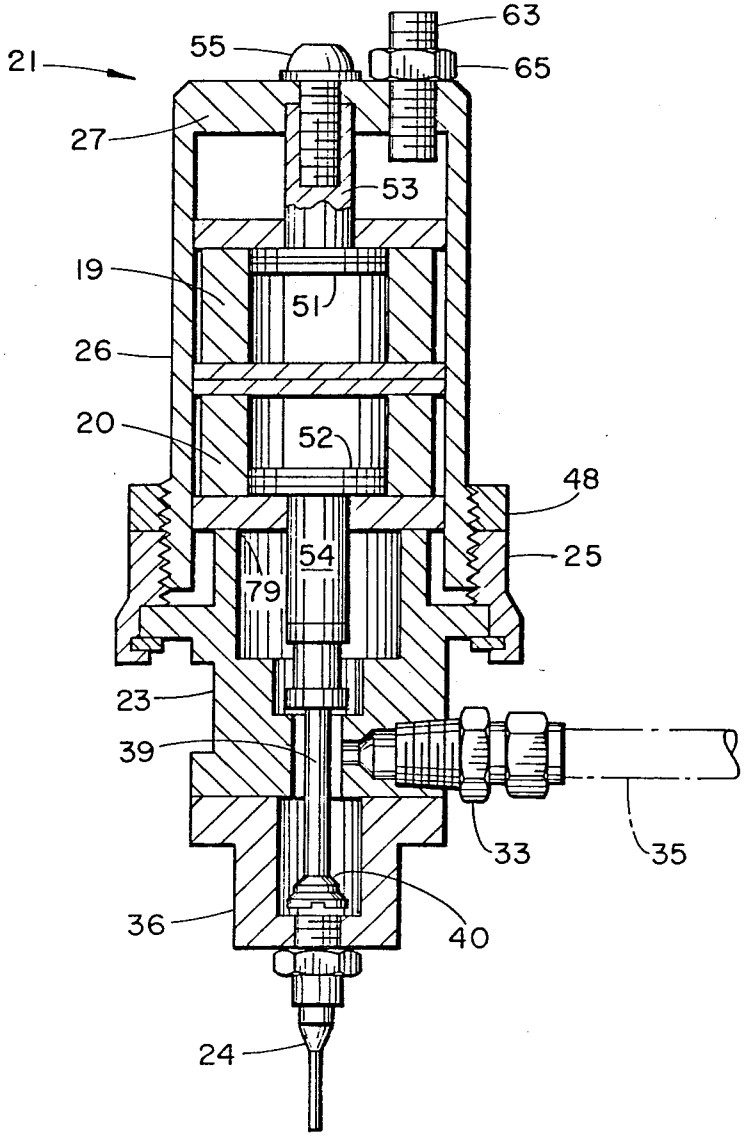
FIG. 7 is a schematic representation as in FIG. 5 with the valve in its high dispense rate position.
Figure 10:
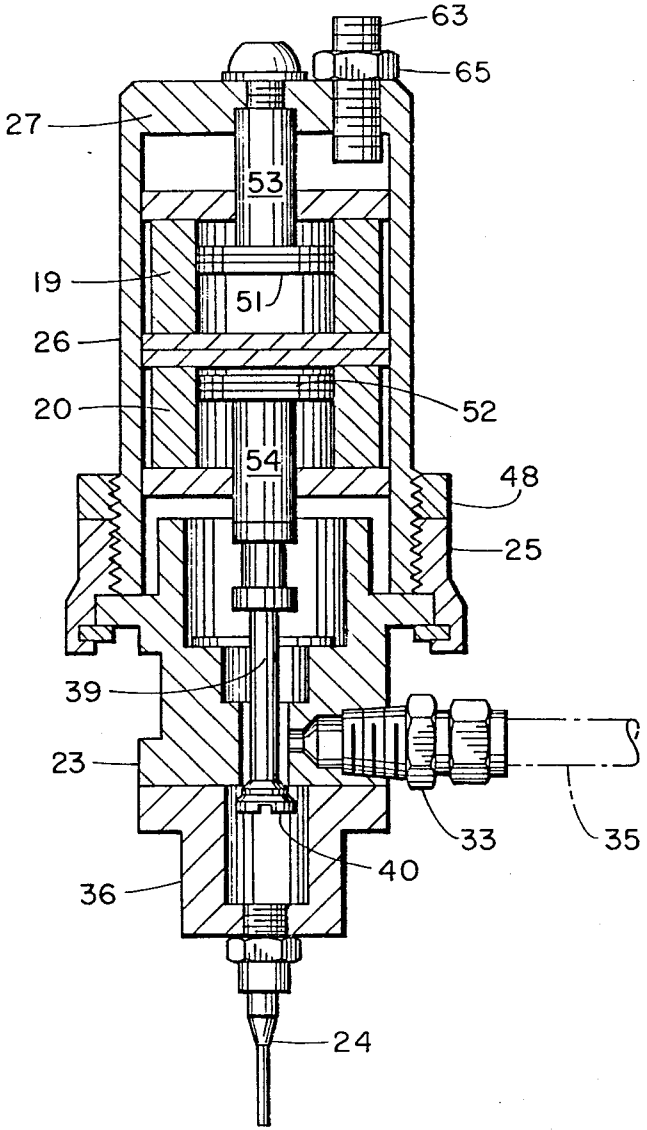
FIG. 10 is a schematic representation as in FIG. 9 showing the housing adjusted to provide a shorter stroke for the bottom piston.

Referring now to FIG. 7, the valve assembly 12 is shown positioned for a high dispense rate. This is accomplished by exhausting port 70, pressurizing port 71, pressurizing port 72 and exhausting port 73. The control system 13 is actuated in a manner such that valve 74 is in its A position and valve 75 is in its B position. This causes the cylinder assembly 19 and 20 to move downwardly against the lower cylinder stop 79 comprising the top of the main body 30. The piston 52 and its piston rod 54 have moved downwardly to the maximum extent thereby pushing the valve stem 39 outwardly from the passageway 31 to the maximum extent as shown.

The valve assembly 12 of this invention is normally actuable to provide at least three positions illustrated in FIGS. 5–7, namely, closed, low-rate, and high-rate positions. In accordance with an alternative embodiment to this invention, the valve assembly 12 can be operated to provide an intermediate or medium dispense rate by actuating the control system 13 to provide the valve arrangement shown in FIG. 8. In this arrangement, the control system 13 actuates the solenoid 77 and 78 so that port 70 is exhausted, port 71 is pressurized, port 72 is exhausted, and port 73 is pressurized. This is accomplished by actuating solenoid 77 to place valve 74 in its A position and actuating solenoid 78 to place valve 75 in its A position. As shown, this causes the cylinder assembly 19 and 20 to move downwardly against the bottom or lower cylinder stop 79 and causes the piston 52 and piston rod 54 to move upwardly to the fullest extent. The result is an extension of the bulbous portion 40 of the valve stem an amount in between the amounts shown in FIGS. 6 and 7. This will result in a medium flow-rate.

Therefore, it is possible with the valve assembly 12 of this invention to provide either three-way operation to provide no, low or high dispense rates, or, alternatively, four-way operation to provide no low, medium, and high dispense rates. Further, this change in operation can be easily accomplished by merely programming the programmable controller 15 to selectively actuate the solenoids 77 and 78 to place the respective valves 74 and 75 in their appropriate positions for obtaining the desired dispense rates.

In operation of the robot 10 as in FIG. 1, the dispense rates of the valve assembly 12 of this invention would be automatically changed as described above from low to high or from low to medium to high as appropriate according to the speed of the dispensing head 11. Therefore, when the dispensing 11 is moving at high speed, such as along a straightaway, a high dispense rate would be employed. When the dispensing head 11 is moving at a low speed as in a tight radius, a low dispense rate would be employed. And finally, in a most preferred embodiment, when the dispense head is moving at an in between speed, then a medium dispense rate would be employed.

The dispense rate of the valve assembly 12 of this invention is determined as previously described by the degree the bulbous portion 40 of the valve stem 39 extends beyond the end of the passageway 31. There is in accordance with whatever structure is built a maximum extension possible. Normally, the valve assembly 12 is operated at less than the maximum extension in order to provide the desired control as previously described. However, when the dispense head is used for dispensing different kinds of materials having different viscosities or different dispense rates are required for a particular application, it is desirable to be able to adjust the absolute dispense rates which are obtained at any of the respective high, medium and low dispense rate divisions of the valve assembly 12.

In contrast to the prior art, this is very easily accomplished in accordance with the valve assembly 12 of this invention. It can be accomplished by using one or both of the following adjustment mechanisms which will be described. The first adjustment mechanism is best illustrated by reference to FIGS. 9 and 10. It utilizes the ability of the housing 21 to move toward or away from the main body 30. This movement is accomplished by rotating the collar 25 about the main body 30. Rotating the collar in one direction, causes the housing 21 to move toward the main body 30. Rotating the collar in the opposing direction causes the housing to move in the opposite direction away from the main body 30.

Figure 9:
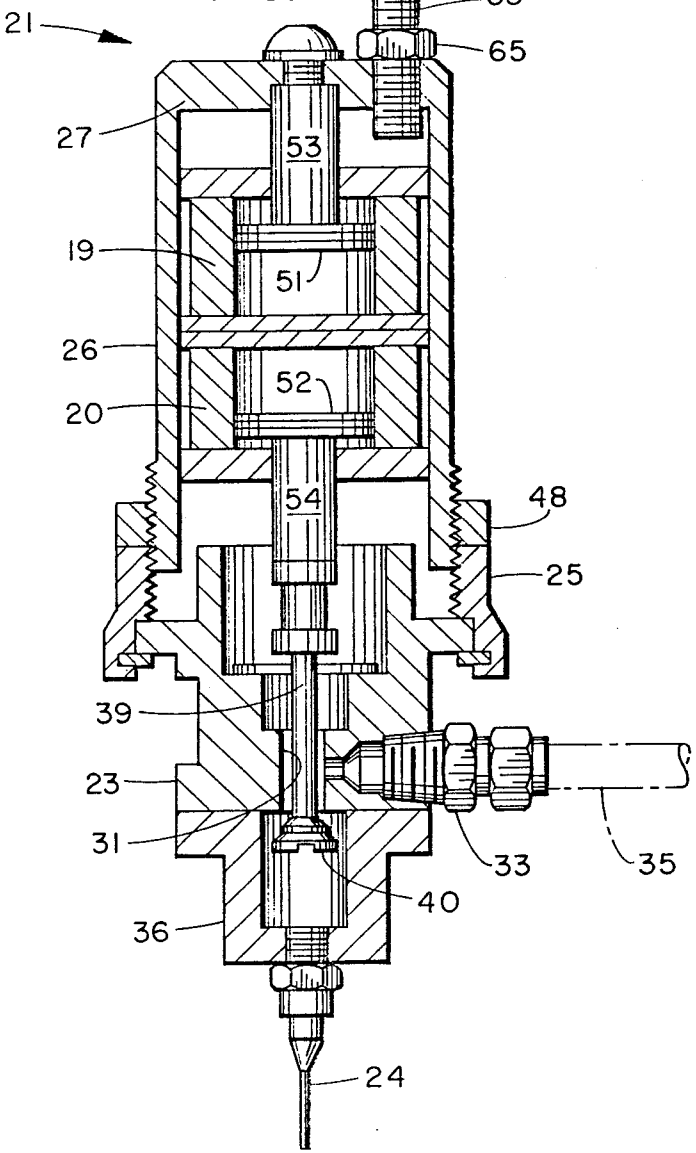
FIG. 9 is a schematic representation as in FIG. 5 showing the housing adjusted to provide a longer stroke for the lower piston.

By moving the housing 21 away from the main body 30 as in FIG. 9, a longer stroke is provided for the valve stem 39. In contrast, by moving the housing closer to the main body 30 as in FIG. 10, a shorter stroke is provided for the valve stem. The reason for this is that in the embodiment of FIG. 9, the cylinder assembly 19 and 20 can move a greater degree than in the embodiment of FIG. 10 and the ultimate stroke of the valve stem 39 is a function of both the movement of the piston 52 and rod 54 and the cylinders 19 and 20. In the embodiment of FIG. 9, the cylinders can move to a greater extent downwardly than in the embodiment of FIG. 10, and, therefore, in the embodiment of FIG. 9, the stroke of the valve stem 39 is greater than in the embodiment of FIG. 10.

Figure 12:
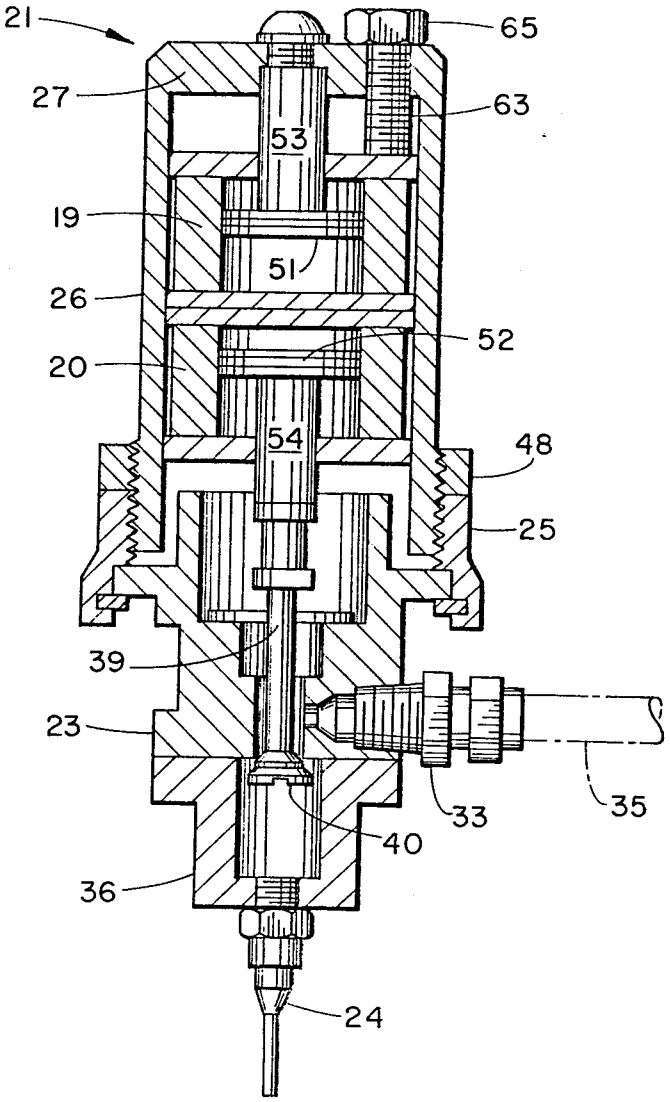
FIG. 12 is a schematic representation as in FIG. 11 showing the top cylinder stop adjusted to provide a shorter stroke for the top piston.
Figure 11:
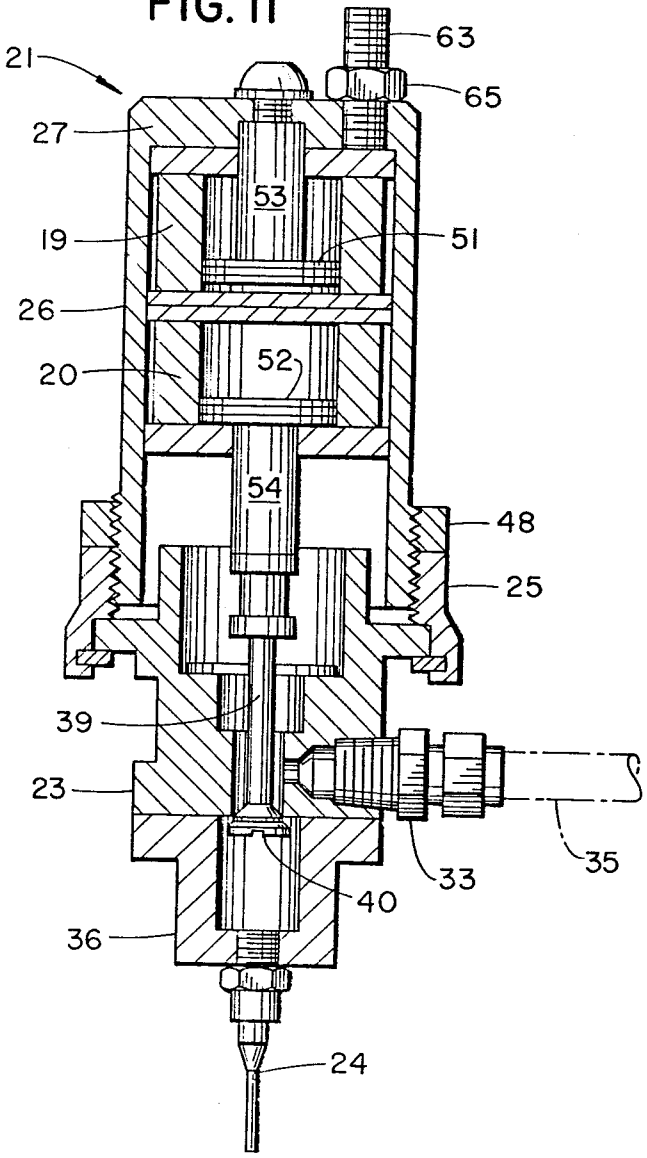
FIG. 11 is a schematic representation as in FIG. 5 showing the top cylinder stop adjusted to provide a longer stroke for the top piston.

Referring now to FIGS. 11 and 12, an alternative means for adjusting the stroke of the valve stem 39 is described. In this case, the top cylinder stop 63 is screwed further into the housing 21, or, alternatively, further out from the housing. In FIG. 11, the screw 63 is substantially withdrawn from the housing 21, therefore, the stroke of the valve stem 39 is larger because the top cylinder stop is relatively high allowing the cylinder assembly 19 and 20 to move to a greater extent upwardly. In FIG. 12, the top cylinder stop has been screwed further into the housing 21, thereby providing a stroke for the valve stem 39 which is shorter because the top cylinder stop is low.

Accordingly, it is possible, by utilizing the top cylinder stop or the lower cylinder stop 79, to adjust the stroke of the valve stem 39. Either of these adjustment devices can used alone or they can be used in combination to provide a desired stroke for the valve stem best suited to provide the desired dispense rates from the valve 12. No matter what the settings for the stroke adjustments, the operation of the valve of this invention as described by reference to FIGS. 5–8 would be the same. The adjustments described by reference to FIGS. 9–12 merely adjust the limits of the dispense rates. The operation of the valve of this invention in accordance with FIGS. 5–8 determines the relative dispense rates within those limits.

It has been found that when the valve is in its closed position, there should be a differential of pressures against the pistons if the pistons have similar size bores. Alternatively, if the pistons have different size bores, the same pressures can be used. The reason for using different pressures when the bores are the same size is that otherwise the valve may freely move within the housing allowing the valve to reopen in an uncontrollable manner. When different pressures are utilized to prevent this from happening, one merely has to apply different air pressures in lines 80–81 from pneumatic source 14.

Figure 13A:
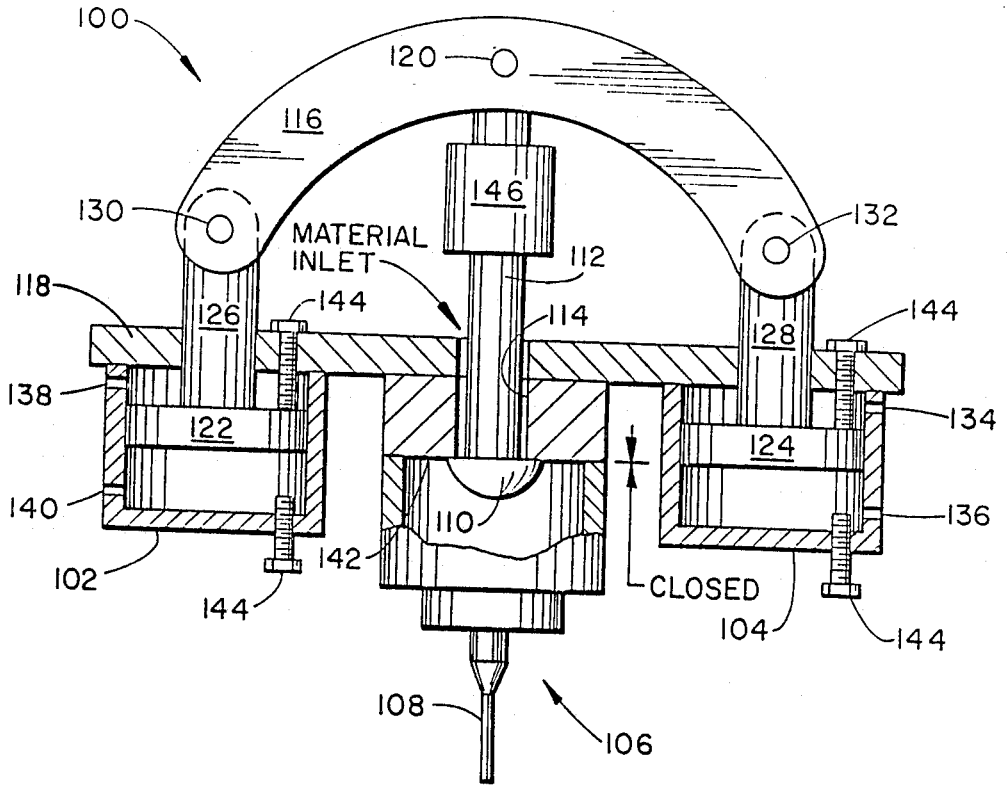
FIG. 13*a–c* are schematic representations of an alternative embodiment of the dispensing apparatus.
Figure 13B:
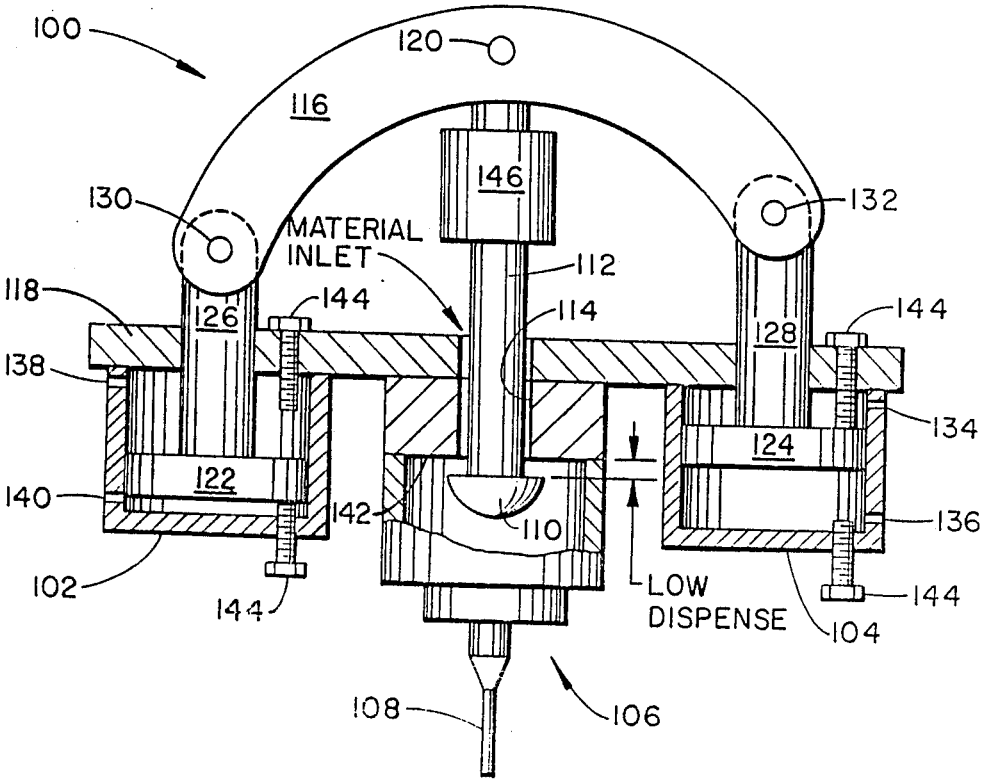
Figure 13C:
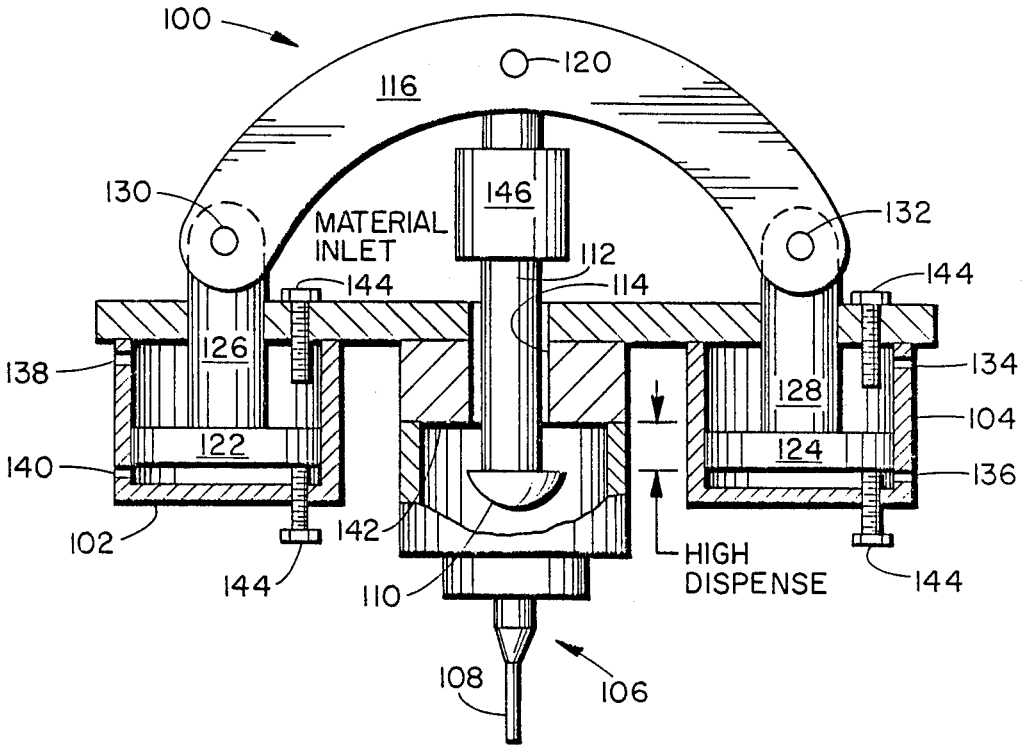

It is possible to separate the two pancake cylinders in an alternative embodiment of the invention as schematically depicted in FIGS. 13*a–c*. In this embodiment, pancake cylinders 102 and 104 are located on either side of the nozzle assembly 106. Valve/nozzle assembly 106 contains nozzle 108 for dispensing sealant or other material which enters assembly 106 at any suitable place such as at "material inlet" and passes through valve stem passageway 114 and bulbous portion 110 of the valve. Valve stem 112 controls the position of bulbous portion 110, the positions of valve stem 112 being controlled by the position of arm 116.

The cylinders 102 and 104 and valve/nozzle assembly 106 are mounted on frame 118. Valve stem 112 is attached to arm 116 at pivot 120. Pancake cylinders 102 and 104 have pistons 122 and 124, respectively, and piston rods 126 and 128, respectively. Piston rods 126 and 128 are attached to arm 116 by pivots 130 and 132, respectively. Cylinders 102 and 104 also have ports 138 and 140 and ports 134 and 136, respectively, that can apply pressurized air or exhaust air to the section of the cylinder on which they are located as desired.

The activation of pistons 122 and 124 can be carried out in similar fashion as described in conjunction with pistons 51 and 52 in FIGS. 2–12 above. The resulting movement of the pistons 122 and 124 is translated through arm 116 to valve stem 112 and bulbous portion 110. In this manner a three position or four position valve can be effected by the structure shown in FIGS. 13*a–c*.

For instance, in FIG. 13*a* the bulbous portion 110 is sealed on valve seat 142 and the valve is in the closed position since no material can get past the bulbous portion to the nozzle. In this condition, piston 124 and piston rod 128 are in their upper positions and piston 122 and piston rod 126 are in their upper positions.

In FIG. 13*b*, the valve is in its low dispense position. Here the bulbous portion 110 has moved away from valve seat 142. This is due to the movement of piston 122 and piston rod 126 from their upper to their lower positions. Piston 124 and piston rod 128 have remained in the same upper position as shown in FIG. 13*a*.

In FIG. 13*c*, the valve is in its high dispense position. Here the bulbous portion 110 has moved away from valve seat 142 even further than in FIG. 13*b*. This is due to the movement of both piston 122 and piston rod 126 and piston 124 and piston rod 128 to their respective lower positions.

An intermediate dispense position is possible also if the amount of movement of piston 124 is different from that of piston 122 between their upper and lower positions. For instance, if piston 122 moved a shorter distance down than piston 124, the low dispense position would be activated by piston 122 solely moving down, the intermediate dispense position by piston 124 solely moving down and high dispense position by both pistons 122 and 125 moving down. The closed position would be the same, that is, both pistons 122 and 124 in their upper positions.

Other than the positions of cylinders 102 and 104, the use of arm 116 and pivots 120, 130 and 132, it can be seen that the operation and structure of the bulbous portion 110 is similar to the embodiments of the invention depicted in FIGS. 2–12. It is noted that provision may have to be made for some lateral movement of valve stem 112 and piston rods 126 and 128 at pivots 120, 130 and 132, respectively, because of the arcuate-like movements of arm 116. This would be particularly desirable if the strokes of piston rods 126 and 128 were large.

It is also possible to obtain different ratios of movements of the valve by varying the distances between the valve stem 112 and piston rods 126 and 128 and making such distances unequal.

It can be also appreciated that adjustments to the dispense rates at low, intermediate and high positions can be readily made. For instance, adjustment stops 144 for the pistons can be used for this purpose. In addition, an adjustment coupling 146, such as that shown in FIGS. 13*a–c*, can be used between the lower and upper valve stem portions to finely adjust the device.

While preferred embodiments of the invention have been disclosed in detail, it should be understood by those skilled in the art that various modifications may be made to the illustrated embodiments without departing from the spirit and the scope thereof as described in the specification and defined in the appended claims.

We claim:

1. A material dispensing valve comprising:

first and second pneumatic cylinders located adjacent one another comprising closed bodies defining respective internal first and second chambers, first and second pistons in sliding arrangement within said respective first and second internal chambers, said pistons dividing each such chamber into a first section adjacent one side of each respective piston and a second section adjacent the other side of each respective piston, first and second piston rods connected to said respective first and second pistons, said piston rods extending in substantially the same direction and outwardly of said bodies; a first port in said first body arranged to communicate with said first section of said first chamber;

a second port in said first body arranged to communicate with said second section of said first chamber;

a third port in said second body arranged to communicate with said second section of said second chamber;

a fourth port in said second body arranged to communicate with said first section of said second body;

said ports being adapted for alternatively pressurizing or exhausting chamber sections;

a frame for supporting said bodies;

means connected to said frame between said bodies for dispensing said material, said dispensing means including a valve for controlling the dispensing rate of said material and actuating means for selectively positioning said valve in at least three positions providing at least a high dispense rate for a first position, a low dispense rate for a second position and no dispense rate for a third position, said actuating means comprising an arm pivotally connected to said valve and said first and second piston rods;

control means for selectively controlling said actuating means for pressurizing or exhausting said respective sections of said cylinders through said ports to adjust said valve to a desired valve dispensing position wherein said first valve position is obtained by said first port being exhausted, said second port being pressurized, said third port being pressurized and said fourth port being exhausted, said second valve position is obtained by said first port being pressurized, said second port being exhausted, said third port being pressurized and said fourth port being exhausted, said third valve position is obtained by said first port being pressurized, said second port being exhausted, said third port being exhausted and said fourth port being pressurized; and whereby said valve is operationally responsive to the movement of said piston rods to provide said at least three valve positions.

2. A dispensing valve as in claim 1 wherein said valve for controlling said dispensing rate comprises a dispensing passageway and a valve stem having a bulbous end arranged for movement within said passageway so that said bulbous end can move toward and away from a free end of said passageway and wherein said valve stem is connected to said arm.

3. A dispensing valve as in claim 2 wherein means are provided for adjusting the stroke of said valve stem to set the overall limit of dispense rate for said respective valve positions.

* * * * *